US006619561B1

(12) United States Patent
Buck

(10) Patent No.: US 6,619,561 B1
(45) Date of Patent: Sep. 16, 2003

(54) FUEL INJECTION VALVE

(75) Inventor: Rainer Buck, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/830,270

(22) PCT Filed: Aug. 12, 2000

(86) PCT No.: PCT/DE00/02736

§ 371 (c)(1),
(2), (4) Date: Aug. 20, 2001

(87) PCT Pub. No.: WO01/14720

PCT Pub. Date: Mar. 1, 2001

(30) Foreign Application Priority Data

Aug. 25, 1999 (DE) ..... 199 40 301

(51) Int. Cl.[7] ..... F02M 47/02

(52) U.S. Cl. ..... 239/88; 239/124; 239/533.2; 239/585.1

(58) Field of Search ..... 239/88–96, 124–127, 239/533.2–533.11, 585.1–585.5; 123/467, 496, 500, 501; 251/129.16, 129.15, 30.02

(56) References Cited

U.S. PATENT DOCUMENTS 5,011,082 A * 4/1991 Ausiello et al. ..... 239/96
5,123,399 A * 6/1992 Motoyama et al. ..... 123/531
5,419,492 A * 5/1995 Gant et al. ..... 239/88
5,464,156 A * 11/1995 Ricco et al. ..... 239/533.8
5,660,368 A * 8/1997 De Matthaeis et al. .. 239/585.1
6,302,087 B1 * 10/2001 Schraudner et al. ..... 123/467

FOREIGN PATENT DOCUMENTS

EP 0548916 A1 * 6/1993
EP 0548916 * 6/1993
EP 0661442 A1 * 7/1995
EP 0661442 * 7/1995
EP 0916842 A1 * 5/1999
EP 0916842 * 5/1999

* cited by examiner

*Primary Examiner*—Michael Mar
*Assistant Examiner*—Dinh Q. Nguyen
(74) *Attorney, Agent, or Firm*—Ronald E. Greigg

(57) ABSTRACT in a fuel injection valve having a valve body, having a control pressure chamber that is disposed inside the valve body and is closed at one end by an actuating part, which is for an injector needle and can be moved in the control pressure chamber between a closed position and an open position, having an inlet into the control pressure chamber, and having an outlet from the control pressure chamber that is controlled by a control valve, the opening speed of the injector needle should be increased. To this end, the mouth opening of the inlet into the control pressure chamber is disposed so that it is at least partially closed by the actuating part when the actuating part moves from the closed position into the open position.

1 Claim, 3 Drawing Sheets

FUEL INJECTION VALVE

CROSS-REFERENCE TO RELATED APPLICATIONS

This application is a 35 USC 371 application of PCT/DE 00/02736 filed on Aug. 12, 2000.

BACKGROUND OF THE INVENTION

1. Field of the Invention

The invention relates to a fuel injection valve having a valve body, having a control pressure chamber that is disposed inside the valve body and is closed at one end by an actuating part, which is for an injector needle and can be moved in the control pressure chamber between a closed position and an open position, having an inlet into the control pressure chamber, and having an outlet from the control pressure chamber which is controlled by a control valve.

2. Description of the Prior Art

A control valve of this kind has been disclosed, for example, by DE 197 27 896 A1 and is used to cause an injector needle of the injection valve to open in order to inject fuel into a cylinder of an internal combustion engine.

The injector needle is permanently acted upon by an opening pressure which strives to lift the injector needle up from the associated valve seat. This opening force counteracts a closing force that is exerted on the actuating part in the control pressure chamber. As long as the pressure in the control pressure chamber is kept at a high level, the closing force produced there is higher than the opening force acting on the injector needle so that the actuating part remains in the closed position and therefore the injector needle remains closed. On the other hand, if the pressure in the control pressure chamber and therefore the closing force produced there decreases, the opening force succeeds in moving the actuating part into the open position as a result of which the injector needle can lift up from the valve seat. Fuel can then be injected.

The pressure in the control pressure chamber is controlled by the control valve by virtue of the fact that the outlet is opened or closed. When the medium, usually fuel, supplied to the control pressure chamber is banked up due to the closing of the outlet, a high pressure is generated in the control pressure chamber which keeps the injector needle in a closed position. On the other hand, if the control valve opens the outlet, the pressure in the control pressure chamber decreases so that the injector needle can open.

SUMMARY OF THE INVENTION

The control valve according to the invention, has the advantage that an increased speed of the injector needle when opening is achieved. This is due to the fact that the cross section of the inlet is reduced by the actuating part when it moves from its closed position toward the open position. Consequently, a variable throttling of the inlet is achieved, which encourages the pressure drop in the control pressure chamber during the opening of the control valve so that less fuel can flow into the control pressure chamber.

According to a preferred embodiment of the invention, the mouth opening has a slot-shaped cross section. This embodiment has the advantage that the reduction of the inlet occurs in proportion to the movement of the actuating part in the control pressure chamber.

BRIEF DESCRIPTION OF THE DRAWINGS

The invention will be explained below in conjunction with an exemplary embodiment which is shown in the drawings in which.

DESCRIPTION OF THE PREFERRED EMBODIMENTS

Figures 1, 2:
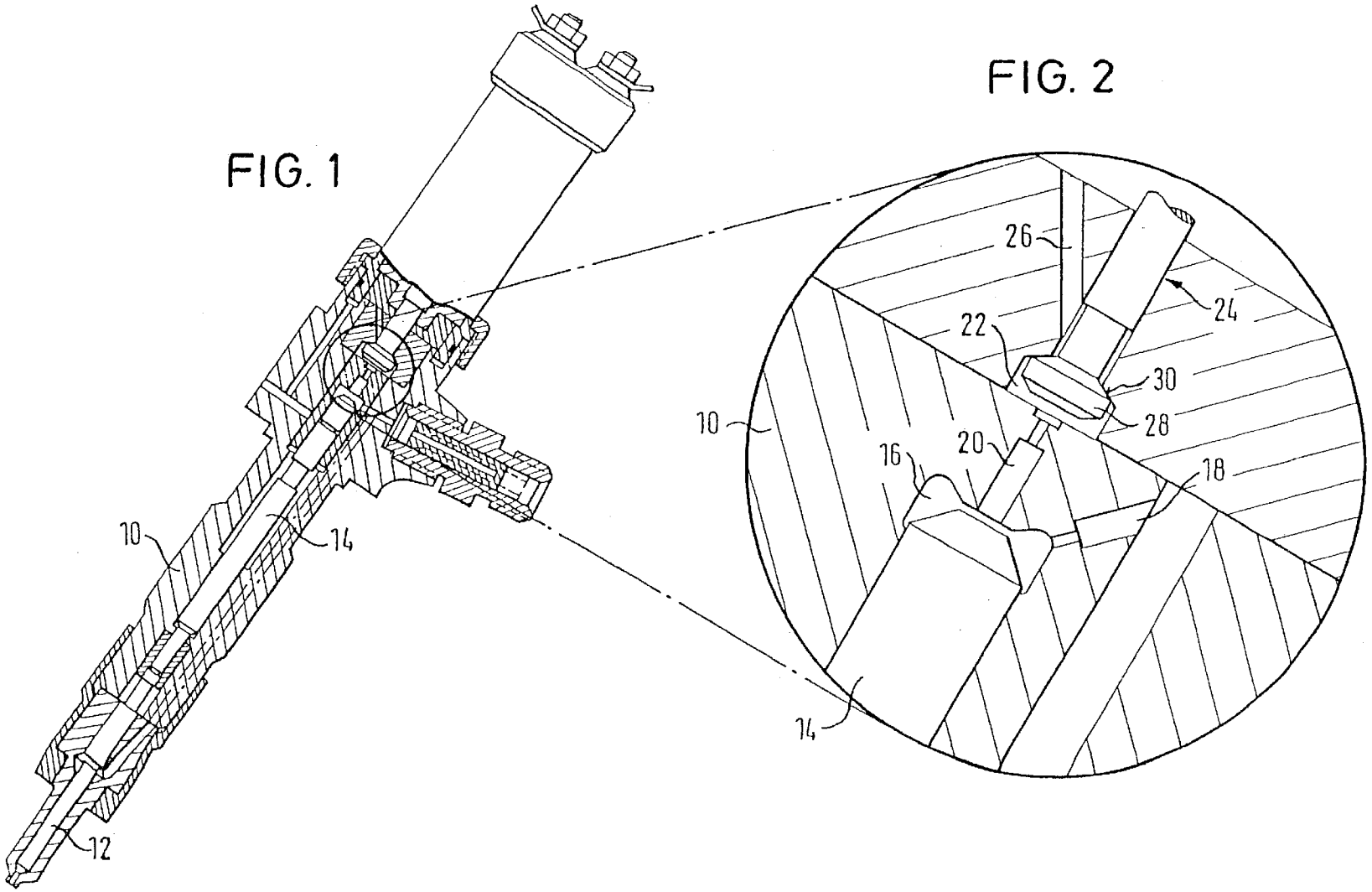
FIG. 1 is a schematic view of a corentional fuel injection valve.
FIG. 2 shows an enlarged detail of a part of the fuel injection valve from FIG. 1.

FIG. 1 shows a conventional fuel injection valve with a control valve (see FIG. 2). The fuel injection valve has a valve body 10 which contains a movable injector needle 12. The injector needle 12 controls the injection of fuel into a cylinder of an internal combustion engine, not shown. The supplied fuel exerts an opening force on the injector needle which strives to move the injector needle and an actuating part 14 on which the injector needle 12 rests toward a control pressure chamber 16.

Fuel is likewise supplied to the control pressure chamber 16 and, due to the pressure prevailing in the control pressure chamber 16, exerts a closing force on the actuating part 14. The fuel is supplied via an inlet 18, and an outlet 20 leads from the control pressure chamber 16 to a control chamber 22 of a control valve 24. The outlet 20 in turn represents the inlet for the control valve 24 and an outlet 26 is provided, through which the fuel can flow out of the control pressure chamber 16 and the control chamber 22.

Inside the control chamber 22, the control valve 24 has a valve needle 28 which cooperates with a valve seat 30. When the valve needle 28 is resting against the valve seat 30, the control valve 24 is closed so that the fuel supplied via the inlet 18 of the control pressure chamber 16 is banked up in this chamber. The high pressure thus produced exerts a closing force on the actuating part 14 that is greater than the opening force acting on the injector needle 12. The actuating part 14 is consequently disposed in the closed position and the fuel injection valve is closed. By contrast, when the valve needle 28 is lifted up from the valve seat 30, the fuel can flow out of the control pressure chamber 16 via the control chamber 22 and the outlet 26 so that the pressure in the control pressure chamber decreases. The subsequently reduced closing force permits the actuating part to move out of the closed position into the open position so that the injector needle opens. Fuel is then injected.

Figure 3:
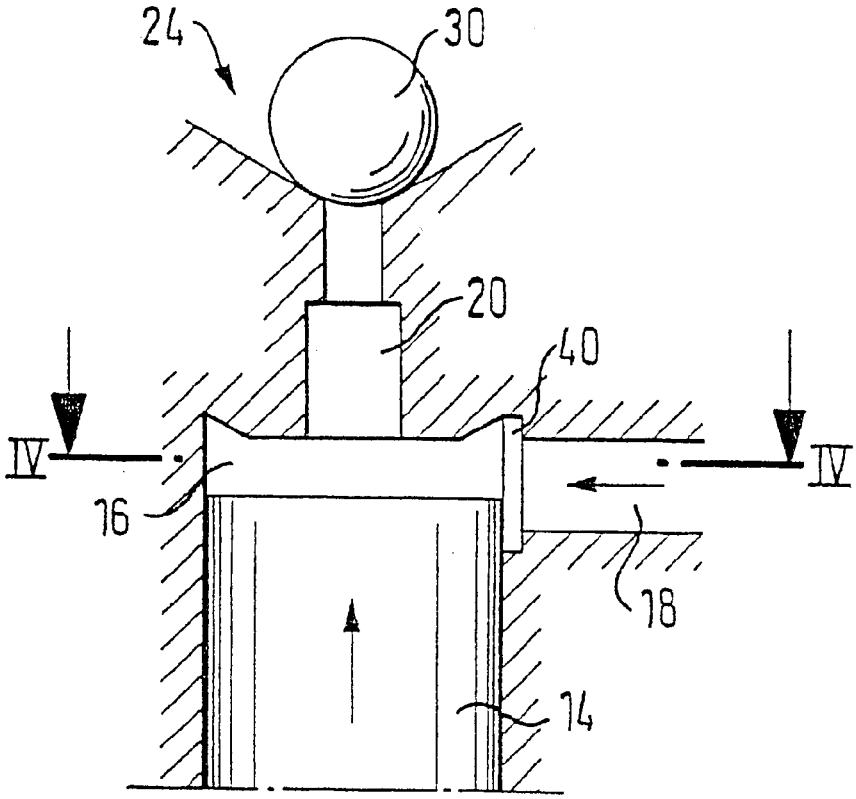
FIG. 3 shows a broken cross-sectional view of a detail of a fuel injection valve according to the invention.
Figure 4:
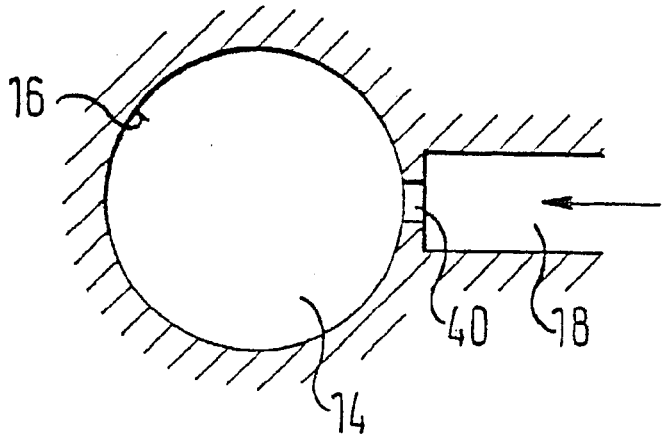
FIG. 4 is a section along the plane IV—IV from FIG. 3.

A fuel injection valve according to the invention is described below in conjunction with FIGS. 3 and 4. In contrast to the known fuel injection valve, in the fuel injection valve according to the invention, the inlet 18 into the control pressure chamber 16 is provided with a slot-shaped mouth opening 40. This mouth is disposed so that the upper end of the actuating part 14 in FIG. 3 gradually closes the mouth opening 40 when it moves starting from the closed position toward the open position. FIG. 3 shows an intermediary state of the actuating part 14 between the closed position and the open position in which the mouth opening 40 is just about halfway closed. Because of this embodiment, when the control valve 30 opens and the actuating part 14 moves into the control pressure chamber 16 due to the pressure drop occurring in it, a throttling of the inlet 18 into the control pressure chamber occurs, which accelerates the pressure drop in this control pressure chamber. A more rapid opening movement of the actuating part 14 and therefore also of the injector needle 12 is consequently produced.

Figure 5:
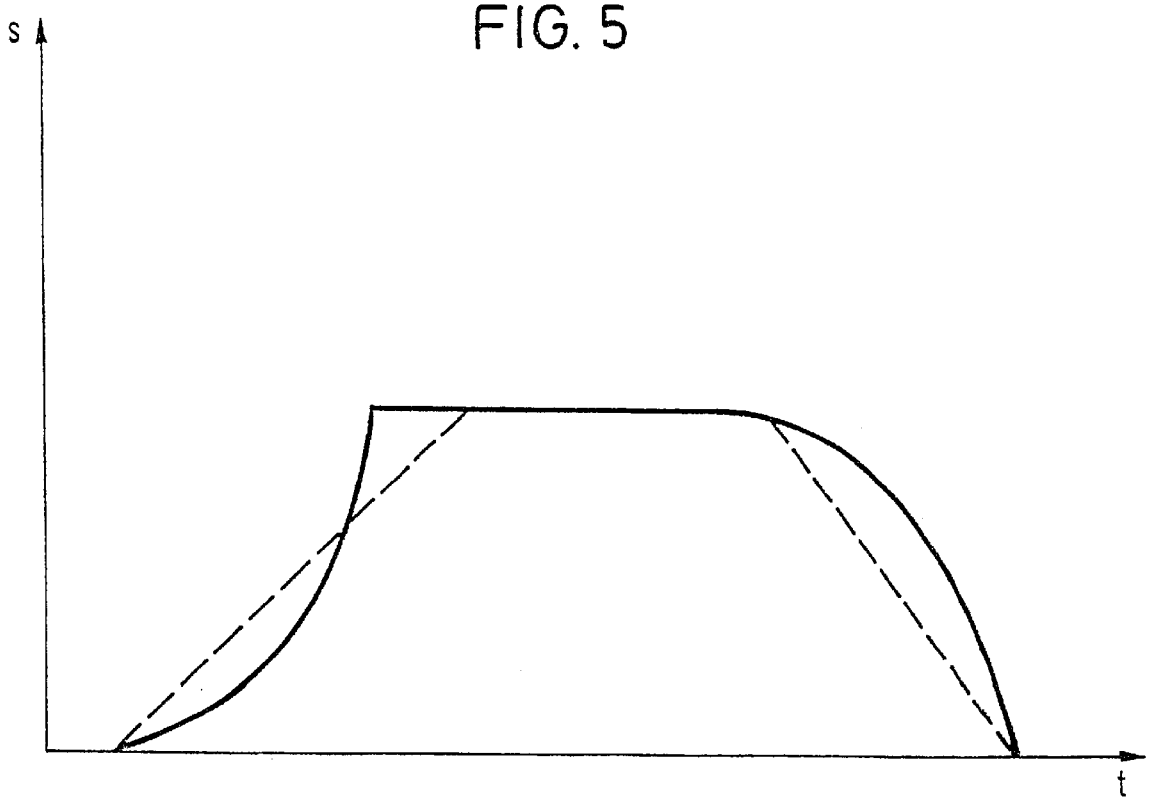
FIG. 5 shows a diagram of the opening stroke of the injector needle of a conventional fuel injection valve and of a fuel injection valve according to the invention.

This can be seen in the diagram shown in FIG. 5. The stroke of the injector needle and consequently the injection progression for a conventional fuel injection valve is shown with a dashed line. It is clear that the injector needle opens comparatively slowly. By contrast, the stroke of the injector needle and consequently the injection progression for a fuel injection valve according to the invention is shown with a solid line. It is clear that a progressively increasing stroke is achieved which leads to a more rapid opening of the injector needle on the whole. The lower needle speed at the beginning of the needle opening permits a more precise control of a preinjection.

The foregoing relates to preferred exemplary embodiments of the invention, it being understood that other variants and embodiments thereof are possible within the spirit and the scope of the invention, the latter being defined by the appended claims.

I claim:

1. In a fuel injection valve having a valve body (10), having a control pressure chamber (16) that is disposed inside the valve body and is closed at one end by an actuating part (14), which is for an injector needle (12) and can be moved in the control pressure chamber (16) between a closed position and an open position of the nozzle needle 12, having an inlet (18) into the control pressure chamber, and having an outlet (20) from the control pressure chamber that is controlled by a control valve (24), the improvement wherein, a mouth opening (40) of the inlet (18) into the control pressure chamber is disposed so that it is at least partially closed by the actuating part (14) when the actuating part (14) moves from the closed position into the open position of the nozzle needle 12, wherein the mouth opening (40) has a slot-shaped cross section.

* * * * *